United States Patent [19]

Tozier et al.

[11] 4,235,590

[45] Nov. 25, 1980

[54] TINTED UV CURED COATINGS FOR PHOTOFLASH LAMPS

[75] Inventors: John E. Tozier; John W. Shaffer, both of Williamsport; William M. Williams, Montoursville, all of Pa.

[73] Assignee: GTE Products Corporation, Stamford, Conn.

[21] Appl. No.: 972,196

[22] Filed: Dec. 22, 1978

[51] Int. Cl.[3] ..... F21K 5/00; F21K 5/02

[52] U.S. Cl. ..... 431/360

[58] Field of Search ..... 431/360

[56] References Cited

U.S. PATENT DOCUMENTS

| | | | |
|---|---|---|---|
| 2,781,654 | 2/1957 | Pipkin | 431/360 |
| 3,242,701 | 3/1966 | Shaffer | 431/360 |
| 3,820,931 | 6/1974 | Ohmae et al. | 431/360 |
| 3,827,850 | 8/1974 | Shaffer et al. | 431/360 |
| 4,076,489 | 2/1978 | Schroeter et al. | 431/360 |

*Primary Examiner*—Joseph Man-Fu Moy

*Attorney, Agent, or Firm*—Edward J. Coleman

[57] ABSTRACT

For use in a color-corrected photoflash unit, a flashlamp having a clear glass envelope with a transparent protective exterior coating comprising a UV curable photopolymer tinted with a colorant providing a portion of the total color correction capability of the unit.

9 Claims, 3 Drawing Figures

TINTED UV CURED COATINGS FOR PHOTOFLASH LAMPS

CROSS-REFERENCE TO RELATED APPLICATIONS

Ser. No. 753,255, filed Dec. 22, 1976, Judith A. Dow et al, "Lamp With Protective Coating And Method of Applying Same," assigned the same as this invention.

Ser. No. 896,279, filed Apr. 14, 1978, Burleigh H. Leach et al, "Method of Applying Protective Coating On Lamp Envelope," assigned the same as this invention.

BACKGROUND OF THE INVENTION

This invention relates to color-corrected photoflash lamps and units and, more particularly, to a tinted protective UV cured coating for flashlamps and color-corrected photoflash units employing such lamps.

A typical photoflash lamp comprises an hermetically sealed glass envelope, a quantity of combustible material located in the envelope, such as shredded zirconium or hafnium foil, and a combustion-supporting gas, such as oxygen, at a pressure well above one atmosphere. The lamp also includes an electrically or percussively activated primer for igniting the combustible to flash the lamp. During lamp flashing, the glass envelope is subject to severe thermal shock due to hot globules of metal oxide impinging on the walls of the lamp. As a result, cracks and crazes occur in the glass and, at higher internal pressures, containment becomes impossible. In order to reinforce the glass envelope and improve its containment capability, it has been common practice to apply a protective lacquer coating on the lamp envelope by means of a dip process. To build up the desired coating thickness, the glass envelope is generally dipped a number of times into a lacquer solution containing a solvent and a selected resin, typically cellulose acetate. After each dip, the lamp is dried to evaporate the solvent and leave the desired coating of cellulose acetate, or whatever other plastic resin is employed.

Another approach to providing a more economical and improved containment vessel is described in U.S. Pat. No. 3,893,797, wherein a thermoplastic coating, such as polycarbonate, is vacuum formed onto the exterior surface of the glass envelope.

Further approaches toward providing improved protective coatings for photoflash lamps are described in the cross-reference Dow et al and Leach et al patent applications, which relate to coatings including UV curable photopolymers. U.S. Pat. No. 4,076,489 Schroeter et al describes a dip method for applying UV cured coatings and photoflash lamps.

During ignition, photoflash lamps produce actinic radiation with a relative deficiency of shorter wavelength visible light, such as blue, and at the same time an abundance of longer wavelength visible light, such as red. Because of this, it is necessary to filter the output of the lamp to render the radiation suitable for taking photographs with color films balanced for use with daylight radiation. Selective filtration is used by those skilled in the art to accomplish proper color balance. Typically, blends of dyes and/or pigments of differing but known absorption spectra are added in various proportions to flashlamp coatings. Alternatively, other photoflash manufacturers incorporate the color correction as a tint within the cover of the photoflash unit rather than in the lamp coating. The commercial dyes added to the lamp coatings, or unit covers, for color-correcting the light output are generally organic in nature. Such dyes, or pigments, also absorb radiation in the ultraviolet region of the spectrum. Dyes used with lacquer or thermoplastic-formed coatings do not interfere with the drying, or thermal forming of the coatings, since ultraviolet radiation is not used in such processes. This is not the case, however, when organic dyes are used in conjunction with the UV cured photopolymer coatings.

Increasing the concentration and/or number of colorants in UV cured photopolymers to obtain proper color balance has an effect of absorbing more UV radiation as additional additives or concentration levels are employed. The net effect is that curing of the coating is retarded, thus weakening the coating and reducing its containment protection qualities. In order to compensate for UV radiation absorbed by the color additives, such color-corrected UV cured coatings must be irradiated for longer time periods to effect proper cure, compared to UV cured coatings which are not colored. Extension of cure time beyond that required for non-colored UV photopolymers unncessarily places limitations on production equipment suited for rapid, in-line coating automation. This, of course, adds to the cost of manufacture.

A further disadvantage is that the need for optimum UV transmission greatly limits the choice of dyes, or pigments, from which the optical filter designer can choose as additives to UV cured coatings. This unnecessarily restricts optimum design of the filter response curve to fully correct lamp emissions toward the goal of standard daylight. Furthermore, some dyes which exhibit desirable filtering characteristics in a liquid solution of UV curable photopolymers can irreversibly fade and/or change to adverse colors as a result of chemical reactions taking place during cure hardening of the photopolymer during UV exposure.

Of course, in a photoflash unit having a transparent cover disposed between the lamp and the exterior of the unit, the color-correcting dye, or pigment could be included in the cover of the unit, with the lamp coating being free of colorants. In such a situation, the optically clear and smooth appearance of the UV cured photopolymer coatings make it quite difficult to detect which flashlamps have and which have not been provided with the protective outer coating. This difficulty is particularly troublesome in the mass production manufacture of flashlamps where, because of the large numbers of lamps handled, there is a possibility of uncoated lamp envelopes becoming intermingled with coated lamps. In order to avoid this undesired possibility, it has been known in the art to alter the visual appearance of a dried coating to facilitate rapid visual inspection. For example, U.S. Pat. No. 2,781,654 Pipkin discloses a flashlamp having a lacquer coating, such as cellulose acetate, containing an ethyl silicate additive which provides a frosted or white appearance when the coating is air-dried. This additive-induced alteration of the coating appearance has the dual purpose of facilitating rapid visual quality inspection and light diffusion. Pipkin also contemplates the addition of color pigments in his coating in order to provide any desired shade or color in the frosted, light-diffusing film, such as may be desired in Christmas tree lamps. Although Pipkin provides a solution to the visual inspection problem of lacquer-coated lamps, the patent does not discuss UV curable photopolymers or the color correction of photoflash lamps or units. Further, the white or light-diffusing lacquer coating provided by the ethyl silicate additive of Pipkin is clearly not compatible with the appearance, light output, strength, and color balance requirements of the photoflash lamps and units which are the subject of the present invention, wherein the coated envelopes and covers are transparent. The lacquer coating tends to be more brittle when modified with ethyl silicate, and the resulting light-diffusing effect significantly reduces light output. Other additives, such as color pigments, in this modified lacquer coating would tend to further reduce light output. When ethyl silicate is added to the preferred UV curable photopolymer, described hereinafter (Hughson Chemical Company Type No. 3254-11), the clarity of the coating mixture is not altered even after curing by exposure to UV radiation. Hence, this additive disclosed by Pipkin is non-functional for its stated purpose in the above-mentioned UV coating for flashlamps and would detract from the coating strength otherwise obtained.

SUMMARY OF THE INVENTION

In view of the foregoing, it is an object of this invention to provide an improved UV-cured photopolymer coating on a photoflash lamp.

A principal object of the invention is to provide a photoflash lamp having a transparent protective coating comprising a UV cured photopolymer which facilitates both rapid visual inspection and proper color correction for photographic applications without degrading the cured coating.

Another object of the invention is to economically provide a color-corrected photoflash unit containing a flashlamp having a transparent UV cured photopolymer coating which facilitates rapid visual inspection of the coated lamp without an adverse effect upon the strength or appearance of the cured coating.

These and other objects, advantages, and features are obtained, in accordance with the invention, by providing on the exterior surrace of the flashlamp envelope a transparent coating comprising a UV curable photopolymer tinted with a colorant providing a portion of the total color correction capability of the photoflash unit in which said lamp is used.

According to another aspect of the invention, a color-corrected photoflash unit is provided which contains a flashlamp having a clear glass envelope and a transparent coating on the exterior surface of the envelope which comprises a UV curable photopolymer tinted with a first colorant. Transparent means, such as an enclosing cover, is disposed between the tinted flashlamp coating and the exterior of the unit and is tinted with a second colorant. The respective colorants are selected such that the tinted means, such as a cover, has a substantially different absorption maxima than the tinted coating on the lamp so that the tinted cover complements the light-filtering capability of the tinted coating to provide the total color correction capability of the unit. In a preferred embodiment, the first and second colorants are organic dyes or pigments, and the tinted photopolymer coating has an absorption maxima near 560 nanometers, while the tinted transparent cover has absorption maxima near 680 nanometers and an absorption minima near 475 nanometers.

In an alternative embodiment of a color-corrected photoflash unit according to the invention, the photopolymer coating on the lamp is tinted with a colorant at a selected concentration which is less than that required to provide a predetermined light output and color balance capability for the unit. The transparent means, such as an enclosing cover, disposed between the tinted flashlamp coating and the exterior of the unit is tinted with the same colorant at a concentration whereby the tinted cover adds to the light-filtering capability of the tinted coating to provide the predetermined light output and color balance capability for the unit.

According to yet another embodiment of the invention, a color-corrected photoflash lamp is provided in which the clear glass envelope thereof has a first transparent exterior coating layer which comprises a UV curable photopolymer tinted with a colorant providing a portion of the total color correction capability of the lamp. A second transparent coating layer covers the first coating layer and comprises a polymer tinted with a colorant which in combination with the tinted first layer provides the total color correction capability of the lamp.

As has been discussed in the background section above, a full complement of the color correcting chemicals in the UV curable photopolymer causes a severe attenuation of UV radiation which retards curing of the photopolymer and degrades the coating performance as a containment medium at the time of flashing. Further, absorption of radiation from a full complement of the color correction chemicals at the time of flashing would elevate the coating temperature and, thus, weaken the protective coating at this time of mechanical stress. Accordingly, the present invention provides a color-corrected photoflash unit in which only a portion of the correction is contained in the UV cured lamp coating so as to minimize the ultraviolet attenuation by the colorant during UV curing, as well as to minimize heat buildup at the time of flash from the presence of the colorant. In addition, the colorant facilitates rapid visual inspection of the cured coating.

BRIEF DESCRIPTION OF THE DRAWINGS

This invention will be more fully described hereinafter in conjunction with the accompanying drawings in which.

DESCRIPTION OF PREFERRED EMBODIMENT

Figure 1:
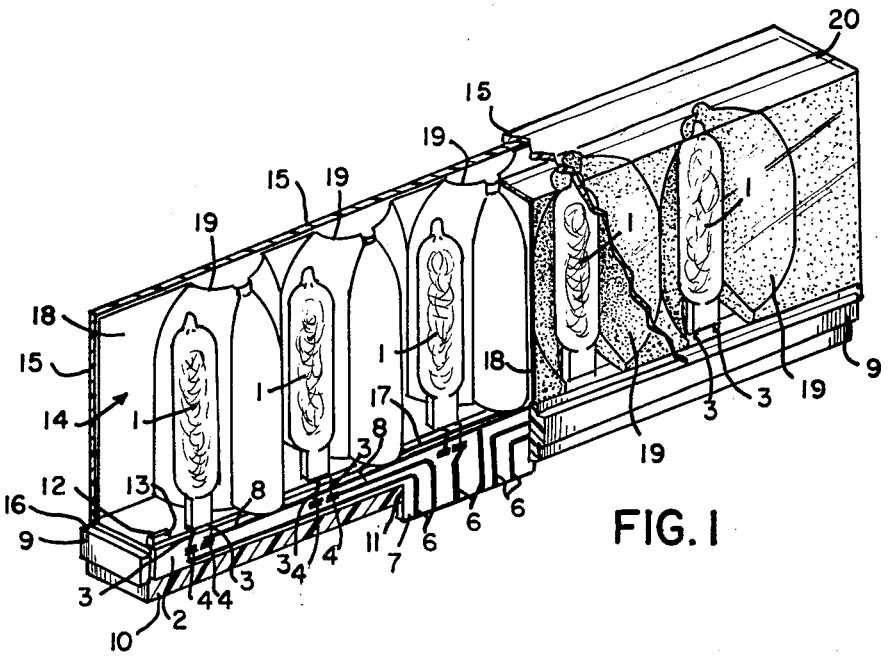
FIG. 1 is a perspective view on an enlarged scale of a photoflash unit according to the invention comprising a two-sided linear array of lamps and reflectors and shown partly broken away in section to more clearly illustrate the construction thereof.

The photoflash unit of FIG. 1, commercially referred to as a flashbar, comprises an assembly of ten lamps 1 arranged in two parallel staggered rows of five lamps each mounted respectively on each side of printed circuit board 2. Each lamp has a pair of spaced, lead-in wires 3 secured, e.g., by soldering or welding, in electrical connection with an adjacent pair of lamp contact areas or pads 4 on the printed circuit board 2. The photoflash lamps 1 are tubular and baseless and, as well known in the art, comprise an hermetically sealed tubular glass envelope containing an ignition filament and filled with oxygen and a filamentary combustible material, such as shredded foil of zirconium or hafnium, which ignites and produces a flash of high intensity light when an electric current is supplied to the ignition filament through the wire leads 3. Further, in accordance with the invention, each of the lamps 1 has a protective coating of UV cured photopolymer tinted with a colorant, as will be described in detail hereinafter.

The printed circuit board 2 may comprise a thin metallic sheet substrate, such as steel, having on both its flat surfaces a coating of an insulating material, such as porcelain, enamel or glass or some other vitreous material, on which is deposited, on each side of the board 2, a printed circuit conductive pattern made of, for example, silver and glass paste. The conductive pattern on each side of the board 2 comprises a plurality of terminal contact areas 6 located on a depending tab portion 7 on the board 2 centrally located along the longitudinal edge thereof opposite the edge of the board from which the lamps 1 upstand. The terminal contacts 6 are in the form of elongated strips that extend parallel to one another and perpendicularly to the edge of the tab 7 and they are selectively interconnected by suitably shaped conductive traces 8 with a plurality of lamp contact areas or pads 4 which are generally aligned adjacent to the opposing edge of the board 2, there being two contact pads for each of the lamps 1. It will be noted that for a row of five lamps 1, there are six of the terminal contacts 6, one for each of the lamps and one that is common to all of the lamps. Accordingly, tab portion 7 is adapted for insertion into an edge connector assembly for operative interconnection with a selective energizing circuit. The printed circuit board 2 is mounted in an upright position within an elongated base 9, which may comprise a single piece formed from a suitable plastic material, such as polystyrene. The base member 9 may be of trough-shaped form, with the printed circuit board 2 received within the hollow interior of the base and resting on the bottom wall 10 thereof, and with the contact tab portion 7 of the circuit board extending down through a centrally located longitudinal through-slot 11 in the bottom wall 10 of the base so as to project from the underside thereof to expose the lamp terminal contacts 6 thereat. The printed circuit board 2 is suitably supported in an upright position within the base 9 by a pair of support posts 12 (a portion of one is shown) projecting upwardly from the bottom wall 10 of the base member and located on opposite sides of the through slots 11. Each post 12 has a longitudinally extending slot 13 aligned with the through slot 11, and the opposite ends of the rigid circuit board are fitted into the slots 13.

In addition to the lamps 1 mounted on the printed circuit board 2 and base 9, the array also comprises a multiple reflector system 14 and a rectangular box-shaped transparent cover 15 of a suitable plastic, such as polystyrene, for enclosing the assembly of photoflash lamps, reflectors, and circuit board. As will be described in more detail hereinafter, the transparent plastic cover 15 is also tinted with a colorant in accordance with the invention.

The reflector system 14 is inserted down between the two rows of lamps 1 and may rest on the shouldered upper rim 16 of the base 9 and on the top edge 17 of the printed circuit board 2. The cover 15 is positioned down over the assembled lamp 1 and reflector system 14 and encases the four sides of the base 9 around the shouldered upper rim portion 16 thereof. The cover 15 may be ultrasonically welded or otherwise suitably fastened to the base 9 to provide a unitary construction for the array that can be plugged into a camera or flash accessory as a unit and then removed and thrown away when all the lamps have been flashed.

As described in U.S. Pat. No. 4,032,769, assigned to the present assignee, the reflector system 14 may comprise a pair of complementary strip like, thin-walled reflector panels 18, each having a row of side-by-side lamp-receiving cavities (five in the particular case illustrated) in its front side formed with reflective surfaces defining individual lamp reflectors 19 for receiving respective ones of the lamps 1 therein, as shown in FIG. 1. The reflector system further includes a channeled web 20 joining the top edges of the reflector panels 18 and providing a spring-hinged center support therefor. Preferably, the reflector panels and channeled web are constituted of a single piece of plastic material such as cellulose proprionate, having a maximum wall thickness of about 15 mils, with the channel 20 and cavities 19 vacuum formed therein. The reflector cavities 19 are provided with suitable specular reflector surfaces, for example, by applying thereto a coating of aluminum or other suitable reflector material by conventional vacuum deposition methods.

Figure 2:
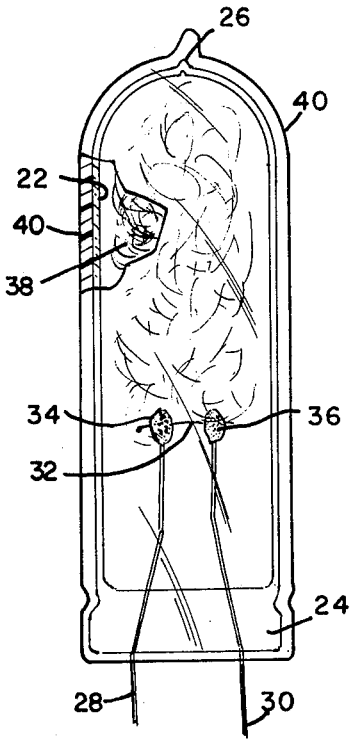
FIG. 2 is an elevational view, partly in section, of an electrically ignitable photoflash lamp having a protective coating in accordance with the invention.

FIG. 2 illustrates an electrically ignitable, filament-type flashlamp of the type suitable for use in the photoflash unit of FIG. 1. The lamp comprises an hermetically sealed lamp envelope 22 of clear glass tubing having a press 24 defining one end thereof and an exhaust tip 26 defining the other end thereof. Supported by the press 24 is an ignition means comprising a pair of lead-in wires 28 and 30 extending through and sealed into the press. A filament 32 spans the inner ends of the lead-in wires, and beads of primer material 34 and 36 are located on the inner ends of the lead-in wires 28 and 30, respectively, at their junction with the filament. Typically, the lamp envelope 22 has an internal diameter of less than one-half inch, and an internal volume of less than one cubic cm. A combustion-supporting gas, such as oxygen, and a filamentary combustible material 38, such as shredded zirconium or hafnium foil, is disposed within the lamp envelope. Typically, the combustion-supporting gas fill is at a pressure exceeding one atmosphere, with the more recent subminiature lamp types having oxygen-fill pressures of up to several atmospheres. As will be described in more detail hereinafter, the exterior surface of the glass envelope 22 is covered with a protective coating comprising a UV cured photopolymer 40 which is tinted with a colorant in accordance with the invention.

For purposes of example, the invention will be described as applied to the electrically ignitable, filament-type photoflash lamp illustrated in FIG. 2 and the flash bar type photoflash unit shown in FIG. 1; however, it is to be understood that the same principles are applicable to high voltage or percussively ignited flashlamps and other types of photoflash units, such as those referred to as flashcubes and the planar arrays commercially known as flip flash units. For example, flashcube structures are described in U.S. Pat. Nos. 3,244,087 and 3,327,105; a percussive flashcube structure is described in U.S. Pat. No. 3,730,669; and the construction of a flip flash unit is described in U.S. Pat. No. 4,113,424.

A percussive-type photoflash lamp is described in several prior patents of the present assignee, for example, U.S. Pat. No. 3,674,411. As described therein, the percussive lamp also includes a sealed glass envelope containing a filamentary combustible material and a combustion-supporting gas; however, the ignition means comprises a metal primer tube sealed in and depending from one end of the glass envelope and containing a coaxially disposed wire anvil partially coated with a charge of fulminating material.

A high-voltage type photoflash lamp is described in a number of patent applications of the present assignee; for example, U.S. Pat. No. 4,059,389. As described therein, the lamp includes a sealed glass envelope containing a filamentary combustible material and a combustion-supporting gas; however, the ignition means comprises a pair of spaced-apart lead-in wires with spherically shaped terminations, a glass frit coating over the lead-in wires, and a coating of primer material over the frit-coated terminations, with the filamentary combustible being in contact with both terminations to provide a conducting path therebetween.

Although somewhat different in structure and operation, the filament, high voltage, and percussive lamps are similar in that in each of the ignition means is attached to one end of the lamp envelope and disposed in operative relationship with respect to the filamentary combustion material. More specifically, the ignition filament 32 of the flashlamp of FIG. 2 is incandesced electrically by current passing through the metal filament support leads 28 and 30, whereupon the incandesced filament ignites the beads of primer 34 and 36, which in turn ignite the combustible 38 disposed within the lamp envelope to provide the actinic light output. Operation of the percussive-type lamp is initiated by an impact onto the primer tube to cause deflagration of the fulminating material up through the tube to ignite the combustible disposed within the lamp envelope. Operation of the high-voltage type lamp is initiated when a high-voltage pulse from, e.g., a piezoelectric crystal, is applied across the two lead-in wires; electrical breakdown of the primer causes its deflagration which, in turn, ignites the shredded metallic combustible.

In accordance with the present invention, the photopolymer coating 40 of the lamp of FIG. 2 is tinted with a colorant, such as a dye or pigment, or blends thereof, which provides only a portion of the total color correction filtering required by the photoflash unit of FIG. 1. The remainder of the color correction is provided by tinting the cover 15 of the photoflash unit. In this manner, rapid visual inspection of the UV cured coating 40 is facilitated while maintaining proper color correction of the light output from the photoflash unit, without retarding curing of the coating, degrading containment integrity, or affecting any loss of light output beyond that necessary for photographic color correction.

Photopolymers suitable for use in the coating 40 and methods of applying the coating are described in the aformentioned Schroeter et al patent and the copending applications of Dow et al and Leach et al. The term "photopolymer" is understood to mean a radiation-curable polymer. Rapid curing of such a polymer results from any stimulus that generates free radicals, such as a source of ultraviolet (UV) light. Ultraviolet light in the 185–400 nanometer wavelength range is required for UV cures. UV light from commercial mercury vapor, mercury-metal halide, or pulsed zenon lamps is effective in the required wavelength range. Curing time with UV light can range from fractions of a second to a minute or more depending upon the film thickness, polymer structure, UV light intensity, and initiator type and concentration. In the present application of coating photoflash lamp envelopes in thicknesses of from 5 to 40 mils, curing time can range from between 0.1 second to 5 minutes, depending on the source power and energy distribution. Curing can be effected in air, under vacuum, or in an inert gas atmosphere.

The photopolymer basically comprises prepolymers used alone or diluted with reactive monomers. To render the material UV curable, however, one must use a photosensitizer or photoinitiator (such as a benzoin ether) which will directly or indirectly give free radicals when exposed to UV radiation even at room temperature. Examples of prepolymers include polyestes, epoxy acrylates, acrylics, polyurethanes, thiolenes, alkenes, or any of a number of general groups. Examples of reactive monomers include styrenes, acrylic and methacrylic esters, and polyfunctional monomers, such as ethylene glycol diacrylate, trimethylol propane triacrylate, and pentaerythritol tetraacrylate. The monomers also serve as viscosity-reducing agents and, as such, they are solvents which dissolve or are miscible with the prepolymer. Accordingly, the reactive monomers reduce the viscosity of the blend to workable levels and/or impart desirable properties to the cured film.

An example of a liquid photopolymer that we have found particularly useful for coating photoflash lamps is an acrylo-urethane resin, available from the Hughson Chemical Company as Type No. 3254-11. In specific embodiments of the present invention, two organic dyes which have been found suitable for use as a tinting additive to this photopolymer resin are a red absorbing blue dye, which provides a tinted coating having a visible absorption minima near 500 nanometers and an absorption maxima near 600 nanometers, and a green absorbing magenta dye, which provides a tinted coating having an absorption maxima near 560 nanometers. The blue dye is available from the American Cyanamid Company, Bound Brook, N.J., as No. BNF 55-3754, and the magenta dye is available from Sandoz Colors and Chemicals, Hanover N.J., as No. Pink 6 BLS. The blue dye was added to the above-mentioned acrylo-urethane photopolymer resin at a concentration of 0.027 weight percent, while the magenta dye was added to the resin at a concentration of 0.001 weight percent. The tinted liquid photopolymer coatings were applied to photoflash lamps according to the techniques described in the aforementioned copending application Ser. No. 896,273 Leach et al to provide a uniform coating 40 thickness of about 0.020 inch over the exterior surface of the glass envelope 22. The coatings were subsequently cured by exposure to UV radiation in the wavelength region of 300 nanometers to 400 nanometers. The blue tinted coating was cured by means of a laboratory setup after an exposure period of about 40 seconds using F6t5 fluorescent lamp sources having a peak output at 350 nanometers; clear photopolymer coated lamps cured under the same laboratory setup also required about 40 seconds exposure for proper cure hardening. The magenta-tinted coatings were cure hardened in a production process in a period of about 25 seconds using FR 40T12 fluorescent lamp sources having a peak output at 350 nanometers; clear photopolymer coatings also required a 25-second exposure period in this production setup. These tinted coatings did not fade or change to adverse colors as a result of the cure hardening process, and as indicated, the individual dye additives did not retard the curing of the photopolymer.

As the red absorbing blue dye would appear to have the more adverse effect upon the photopolymer coating temperature at the time of lamp flashing, the above-described blue-tinted 20-mil coatings were applied to special test lamps of the type described in U.S. Pat. No. 3,955,912. These lamps contain a readily ignitable hydrogen-containing substance, such as shredded paper, to controllably induce bursting of the lamp upon ignition for purposes of testing the relative strength and reliability of the lamp containment vessels, including the glass envelope and outer coating. Upon flashing 49 of such test lamps coated with the blue tinted photopolymer resin, about 8% of the lamps were observed to have coating failure causing a rupture. For purposes of comparison, a control test was then run by flashing 51 of the same type test lamps having a clear (colorless) photopolymer coating applied in the same manner as the tinted coating. After flashing, about 8% of these clear coated lamps were also observed to exhibit coating failures causing ruptures. It is clear, therefore, that the UV cured coating performance is not degraded at the time of flashing by virtue of the blue dye additive.

The above-described magenta-tinted photopolymer resin was coated on a total of 640 production lamps which were assembled in commercial flash bar photoflash units of the type shown at FIG. 1. Coated lamps were cure hardened in the production process for a period of 25 seconds. Upon flashing all 640 of the lamps, no coating ruptures were observed.

In accordance with the invention, the cover 15 for this flash bar unit was tinted with a blue pigment blend (e.g. pigment blend No. 8137 available from Plastic Compounders, Cambridge, Ohio) to yield an absorption maxima near 680 nanometers and an absorption minima near 475 nanometers. Accordingly this tinted cover 15 complemented the filtering of the magenta-tinted photopolymer coatings on the flashlamp 1 mounted within the unit to provide the total color correction required. The Spectral Distribution Index, SDI (American National Standard No. PH 2.28-1967, R73) was acceptable and was within 2 SDI units from reference measurements.

If the above-described blue-tinted photopolymer coatings were employed on the flashlamps within the flash bar unit of FIG. 1, the total color correction capability of the unit would be obtained by incorporating the above-described magenta tint in the transparent cover 15.

Either dye, as the sole additive to the UV-cured resin, permitted rapid visual inspection of the coating. As previously mentioned, coatings without any colorant are difficult to inspect because of their optical clarity. Furthermore, the glass-like optical clarity of untinted UV-cured coatings is such that inadvertent mingling of uncoated and coated lamps could occur in production. Such uncoated lamps would be difficult to observe and pick out. Further, such uncoated lamp envelopes provide insufficient containment when flashed and do not render the properly corrected light output required for acceptable photographic results. Incorporating only a portion of the color correction in the UV-cured coating minimizes coating temperature during flashing and provides maximum coating strength.

According to an alternative embodiment of the invention, the desired objective of tinting without degrading coating integrity or color correction quality may be provided by incorporating a portion of each of the required color-correcting components into the UV-curable resin, but at a concentration lower than that adequate for proper light output and color balance, the remaining portion of the color correction filtering being located other than in the lamp coating, such as in the transparent cover 15. For example, the coating 40 on the flashlamps of the unit of FIG. 1 may comprise a UV-curable photopolymer resin with a tinting additive comprising both of the above blue and magenta dyes at respectively reduced concentrations. As a specific example, the blue dye having an absorption maxima near 600 nanometers may be at a concentration of 0.013 weight percent in the photopolymer resin, rather than the previously mentioned 0.027 weight percent. The magenta portion of the tint for yielding an absorption near 560 nanometers may be added to the resin at a concentration of 0.0005 weight percent, rather than the previously mentioned 0.001 weight percent. These reduced concentrations of the two dyes in the photopolymer coating are less than that required to provide a predetermined light output and color balance capability for the unit. Accordingly, the transparent cover 15 is tinted with these same two blue and magenta dye components at concentrations whereby the tinted cover adds to the light-filtering capability of the tinted coating to provide the predetermined light output and color balance capability for the unit.

Figure 3:
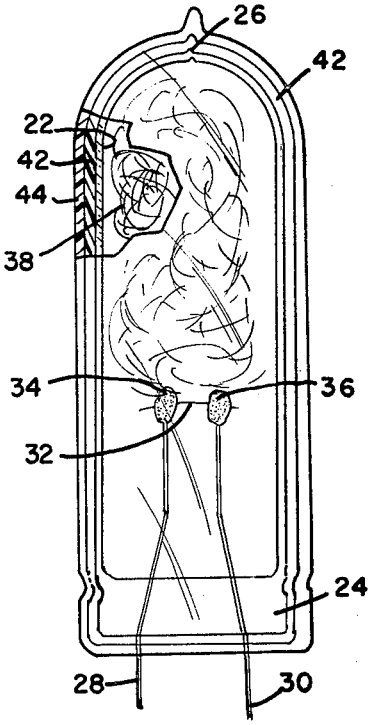
FIG. 3 is an elevational view, partly in section, of an electrically ignitable photoflash lamp having a multilayer protective coating in accordance with the invention.

In another alternative embodiment of the invention, the protective coating on the lamp envelope may consist of multiple layers or applications with all but a portion of the color correction incorporated into any layer or combination of layers; this includes lamp coatings having layers that are dissimilar, e.g. a UV-cured coating layer and a lacquer coating layer, or a UV-cured coating layer and a polycarbonate vacuum-formed sleeve. For example, refer to FIG. 3, which shows a two-layer coating on an electrically ignitable, filament-type flashlamp similar to that shown in FIG. 2 and having similar elements identified with the same reference numerals. The first coating layer 42 on the exterior surface of the glass envelope 22 comprises a UV-curable photopolymer tinted with a colorant providing a portion of the total color-correction capability of the lamp. That coating may have a thickness of say about 10 mils. A second transparent coating layer 44 covers the first coating layer 42 and comprises a polymer tinted with a colorant which in combination with the tinted first layer comprises the total color capability of the lamp. For example, the outer coating 44 may comprise another UV-curable photopolymer layer, or a lacquer coating, or a polycarbonate sleeve, and having a thickness of the order of about 10 mils. As a specific example, the first coating layer 42 may be tinted with the above-described magenta dye at a concentration of about 0.001 weight percent and yielding an absorption maxima near 560 nanometers. In combination with this filter coat, the second coating layer 44 may be tinted with the above-described blue dye at a concentration of 0.027 weight percent and providing a visible absorption maxima near 600 nanometers.

Alternatively, the first coating layer 42 may be tinted with a colorant comprising both the blue and magenta components at a reduced concentration. The second coating layer 44 may then be tinted with the same colorant but at a concentration whereby the tinted second layer adds to the light-filtering capability of the tinted first layer 42 to provide a predetermined light output and a color capability for the unit.

Although the invention has been described with respect to specific embodiments, it will be appreciated that modifications and changes may be made by those skilled in the art without departing from the true spirit and scope of the invention. For example, concentrations and selection of appropriate colorants are not limited to the types and levels described.

What we claim is:

1. A color-corrected photoflash unit comprising, in combination, a flashlamp having a clear glass envelope and a transparent coating on the exterior surface of said envelope, said coating comprising a UV curable photopolymer tinted with a first colorant, and transparent means disposed between said tinted flashlamp coating and the exterior of said unit, said transparent means being tinted with a second colorant whereby said tinted transparent means has a substantially different absorption maxima than said tinted coating and complements the light-filtering capability of said tinted coating to provide the total color correction capability of said unit.

2. The photoflash unit of claim 1 further including a base upon which said flashlamp is mounted, and wherein said transparent means comprises a cover member mounted on said base and enclosing said flashlamp.

3. The photoflash unit of claim 1 wherein said first and second colorants are organic dyes, said tinted photopolymer coating has an absorption maxima near 560 nanometers, and said tinted transparent means has an absorption maxima near 680 nanometers and an absorption minima near 475 nanometers.

4. A color-corrected photoflash unit comprising, in combination, a clear glass envelope and a transparent coating on the exterior surface of said envelope, said coating comprising a UV curable photopolymer tinted with a colorant at a selected concentration in said photopolymer which is less than that required to provide a predetermined light output and color balance capability for said unit, and transparent means disposed between said tinted flashlamp coating and the exterior of said unit, said transparent means being tinted with said colorant at a concentration whereby said tinted transparent means adds to the light-filtering capability of said tinted coating to provide said predetermined light output and color balance capability for said unit.

5. The photoflash unit of claim 4 further including a base upon which said flashlamp is mounted, and wherein said transparent means comprises a cover member mounted on said base and enclosing said flashlamp.

6. The photoflash unit of claim 4 wherein said colorant comprises two component dyes, each yielding a substantially different absorption maxima than the other when separately used as a tint.

7. A color-corrected photoflash lamp having a clear glass envelope, a first transparent coating layer on the exterior surface of said envelope, said first coating layer comprising a UV curable photopolymer tinted with a colorant providing a portion of the total color correction capability of said lamp, and a second transparent coating layer covering said first coating layer, said second coating layer comprising a polymer tinted with a colorant which in combination with said tinted first layer provides said total color correction capability of said lamp.

8. The photoflash lamp of claim 7 wherein said first coating layer is tinted with a first colorant and said second coating layer is tinted with a second colorant whereby said tinted second layer has a substantially different absorption maxima than said tinted first layer and complements the light-filtering capability of said tinted first layer to provide the total color correction capability of said lamp.

9. The photoflash lamp of lamp 7 wherein said first coating layer is tinted with a colorant at a selected concentration in said photopolymer which is less than that required to provide a predetermined light output and color balance capability for said lamp, and said second coating layer is tinted with said colorant used in said first layer but at a concentration whereby said tinted second layer adds to the light-filtering capability of said tinted first layer to provide said predetermined light output and color balance capability for said unit.

* * * * *